US006089062A

United States Patent [19]

Zemp

[11] Patent Number: 6,089,062

[45] Date of Patent: Jul. 18, 2000

[54] METHOD FOR CONTROLLING, MONITORING AND CHECKING A SHAPING PROCEDURE OF A SHAPING MACHINE, IN PARTICULAR RIVETING MACHINE

[75] Inventor: Thomas Zemp, Kloten, Switzerland

[73] Assignee: BALTEC Maschinenfabrik AG, Switzerland

[21] Appl. No.: 09/078,107

[22] Filed: May 13, 1998

[30] Foreign Application Priority Data

Mar. 20, 1998 [DE] Germany ..... 198 12 133

[51] Int. Cl.[7] ..... B21C 51/00

[52] U.S. Cl. ..... 72/21.4; 72/17.2; 72/20.4; 72/21.5

[58] Field of Search ..... 72/17.1, 17.2, 72/19.8, 19.9, 20.1–20.4, 21.4, 21.5, 453.02, 453.04, 453.06, 453.18, 453.19; 29/243.53, 243.54

[56] References Cited

U.S. PATENT DOCUMENTS 5,031,431 7/1991 Naito ..... 72/215

*Primary Examiner*—Ed Tolan
*Attorney, Agent, or Firm*—Bachman & LaPointe, P.C.

[57] ABSTRACT

In a method for controlling, monitoring and checking a shaping procedure of a shaping machine, in particular riveting machine (R) on a workpiece (27) by means of a plunger (4) which is moved into contact with the workpiece (27), an upper plunger face (9) and/or a lower plunger face (10) for moving the plunger (4) being subjected to pressure, a change in pressure and/or change in force is measured when the plunger (4) strikes against the workpiece (27), in order to determine the start of a shaping operation, in particular the start of a riveting operation.

23 Claims, 2 Drawing Sheets

Figure 1:
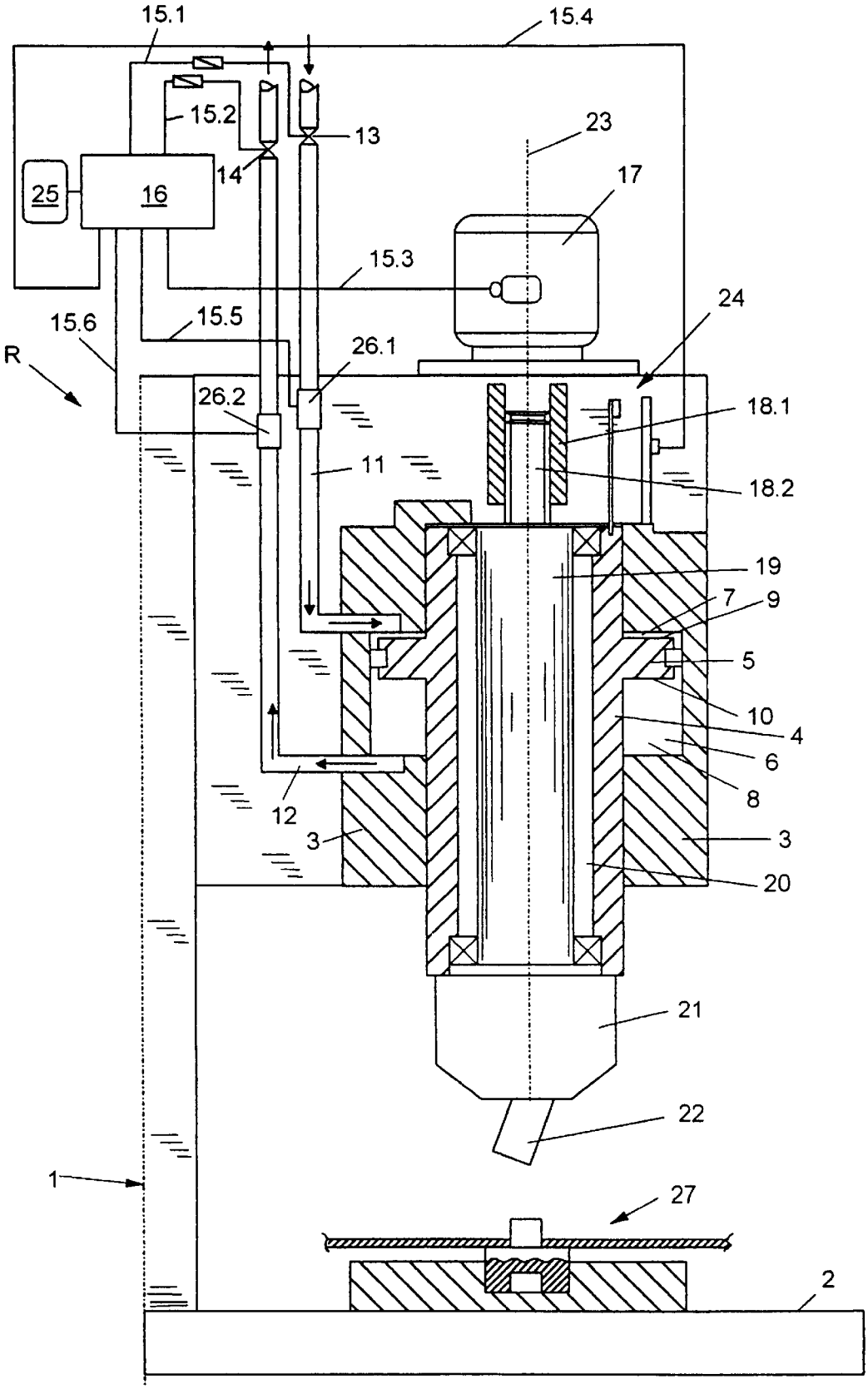

METHOD FOR CONTROLLING, MONITORING AND CHECKING A SHAPING PROCEDURE OF A SHAPING MACHINE, IN PARTICULAR RIVETING MACHINE

The present invention relates to a method for controlling, monitoring and checking a shaping procedure of a shaping machine, in particular riveting machine, on a workpiece by means of a plunger which is moved into contact with the workpiece, an upper plunger face and/or a lower plunger face being subjected to pressure in order to move the plunger, and a shaping machine being operated according to the above-mentioned method.

Shaping machines, in particular riveting machines, are known in the prior art, and are customary, in a very wide variety of forms and designs. They are used primarily to perform mechanical material deformations, in particular also riveting operations, by machine. In this context, it is to be possible to incorporate such machines into automation processes. Here, in the context of the manufacturing of rivet connections by means of a riveting machine, this means essentially cold deformations, since two parts have to be connected to one another during the material deformation.

Given the inevitable high level of automation which is increasingly demanded, independent checking of the degree of shaping, in particular the riveting, is absolutely necessary since very high demands are made of rivet connections today. For this reason, it is imperative to check and detect a faulty rivet connection.

EP 0 699 490 A1 discloses a device for checking material deformations, if appropriate a deviation being sensed via two different travel sensor arrangements and via sensing elements. A disadvantage here is that such a device is costly and complex to manufacture and does not permit the start of a riveting operation to be determined precisely.

In addition, DE 37 15 905 C2 discloses a method for manufacturing rivet connections by machine, and a rivet machine for carrying out the method, in which machine a riveting set is displaced out of a prescribed zero position into contact with a workpiece. This displacement against a workpiece is carried out with a measuring force which is smaller than the force necessary for deforming the rivet. The forward feed travel of the riveting set which is brought about by the measuring force is measured and is compared, as an actual value, with a setpoint value. The disadvantage with this is that it is not possible to move against the rivet with the full forward feed force. It is not possible to monitor the complete riveting process here.

The present invention is based on the object of providing a method for controlling, monitoring and checking a shaping procedure and a shaping machine, in which it is possible to sense the start of a shaping operation or the start of a riveting operation precisely. Afterwards, it is to be possible to infer precise information on faulty shaping procedures. In addition, the considerable manufacturing costs for such a shaping machine are to be reduced. Said machine is to be very lightweight and simple to control while increasing the shaping quality.

This object is achieved by measuring a change in pressure and/or a change in force when the plunger strikes against the workpiece, in order to sense the start of a shaping procedure, in particular the start of a riveting procedure.

Such a change in pressure, which is measured in a pressure line and/or venting line, for moving the plunger, or in an upper plunger space or a lower plunger space itself by means of at least one sensor element, determines the precise start of a shaping operation when the plunger strikes against a workpiece. As a result of the direct impacting against a workpiece during the movement of a plunger or of a rivet head, a change in pressure occurs which is detected and sensed directly in the sensor element, in particular pressure sensor. From a change in pressure it is also possible to determine and control precisely the change in the force with which the shaping is effected. A change in force can also provide decisive information on the start of the shaping operation.

Preferably, the sensor element should be provided in the machine housing near to the upper and/or lower plunger space. The latter is connected to a control device which evaluates the data.

In the present invention, it is also advantageous that the plunger can be moved against the workpiece permanently with full forward feed and, if appropriate, constant forward feed force during the shaping operation. Directly when the riveting tool strikes against the workpiece, only the change in pressure is displayed and then a prescribed distance, in particular a further, shaping distance, can be traveled along by means of a travel measuring device until the predetermined travel has been reached within a specific time. On the other hand, the plunger can also be moved in contact with the workpiece with a predetermined forward feed force or shaping force for a specific time until, after a specific shaping or comparison time, the shaping takes place as desired.

By means of prescribed comparison parameters which can be sensed, for example, by means of trials, it is possible to sense precisely whether the shaping has taken place as desired. It is possible to sense precisely whether, for example, the rivet is too long, whether there is a rivet present at all or whether the shaping time or the shaping travel has been carried out precisely. This is possible by sensing the precise start of the shaping operation.

Therefore, the present invention provides a method and a shaping machine with which the start of a riveting operation and/or the start of a shaping operation can be sensed very precisely. Here, during the shaping operation, for example over a predetermined travel, the time for a specific shaping travel can be used as comparison criterion in order to obtain precise information on faulty or non-faulty shaping.

In addition, it is also possible that the time is prescribed and the shaping travel covered during this time is used as comparison criterion for determining a shaping condition. This ensures that even an automated shaping process can be continuously monitored and controlled.

It also lies within the scope of the present invention that a predetermined shaping distance is traveled after the start of a shaping operation or the start of a process is determined, a shaping process being monitored and a shaping result being determined by means of a time comparison and/or an additional comparison of the shaping force (effective force effect in Newton N) on the material to be riveted and/or workpiece, the time unit and/or the force at the moment at which the prescribed shaping travel is reached. This can be effected by means of prescribed force windows and/or time windows which provide information on a tolerance limit range. Time and force may be sensed continuously throughout the shaping process. The sampling rate can be, for example, 100 Hz and it yields the shaping work performed per time unit as a variable.

It is also advantageous that faults are detected very precisely and/or the cause of the fault is preferably always determined by means of two comparison variables with a prescribed parameter, so as to exclude a situation in which two faults with inverse values compensate one another and thus prevent a fault being detected.

If, for example, material to be riveted is faulty and too soft, the riveting time for the distance traveled would be too short. The shaping would be faulty. If, for example, there is a pressure loss on the system, for example as a result of leakages, the riveting time would be too long. If these two faults occur, for example, simultaneously, both faults would cancel one another out and it would not be possible to detect this. This possibility is eliminated by virtue of the fact that two comparison variables are preferably always used as comparison criterion. This makes it possible to determine faults precisely. These comparison criteria ensure not only the final result but also the complete shaping processes as a function of the process variables of shaping force, shaping time, shaping travel etc. By means of the individual parameters such as travel, speed, time and pressure differential, the shaping force and shaping travel per time unit in shaping work can easily be determined.

The shaping work which can be determined per time unit also permits the riveting process to be evaluated precisely, and in particular makes it possible to infer precise information on strength properties of the shaped workpiece.

Figure 2:
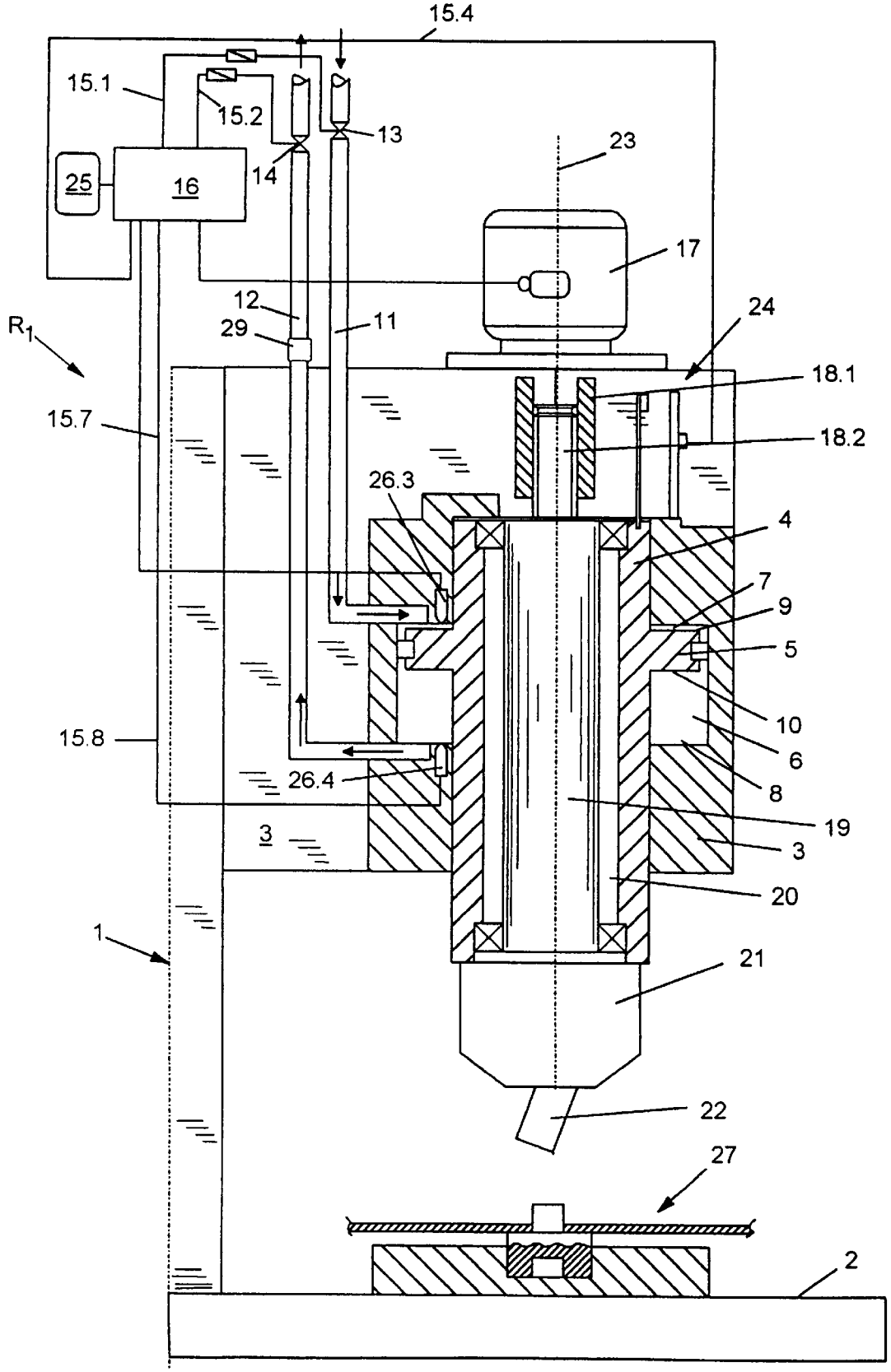

Further advantages, features and details of the invention emerge from the following description of preferred exemplary embodiments and with reference to the drawing; in which FIG. 1 shows a schematically illustrated partial longitudinal section through a riveting machine according to the invention;

FIG. 2 shows schematically illustrated partial longitudinal section through a further exemplary embodiment of the riveting machine according to FIG. 1.

FIG. 1 indicates a shaping machine, in particular riveting machine R which essentially has components of a conventional riveting machine such as is shown in EP 0 699 490 A1. Reference is expressly made to this prior art since essentially all the components of a conventional riveting machine are described in detail therein. For this reason, further description of the individual components is dispensed with.

A shaping machine R has a machine frame 1, which is indicated here only by broken lines and which has a vertical bearing arm (only indicated) which is adjoined by a support face 2 preferably at a right angle. The support face 2 bears the workpieces 27 to be processed. These are not given individual reference numerals here. Secured to the machine frame 1, and in particular to the vertical supporting arm, is a machine housing 3 which is hollow in the interior. A displaceable pneumatic plunger 4, which is preferably hollow, is arranged in the machine housing 3. A protruding flange 5, which is guided in a cavity 6 of the machine housing 3, projects preferably outward from the plunger 4. The cavity 6 is divided into an upper plunger space 7 and lower plunger space 8 by the protruding flange 5. Accordingly, the protruding flange 5 has an upper plunger face 9 which is directed toward the upper plunger space 7, and a lower plunger face 10.

A pneumatic or hydraulic pressure line 11 preferably leads into the upper plunger space 7. The lower plunger space 8 is adjoined at the bottom by a pneumatic or hydraulic venting line 12. A control valve 13, 14, a throttle, is inserted into the pressure line 11 and venting line 12, respectively, said throttle being connected via connecting lines 15.1, 15.2 to a control device 16. A further connecting line 15.3 constitutes the connection to a drive motor 17, an electric motor. The latter may also be designed as a hydraulic motor. The electric motor drives a sleeve 18.1 in which a protruding end 18.2 of a drive shaft 19 is mounted in a displaceable fashion. The drive shaft 19 is rotatably mounted in a cavity 20 of the plunger 4 by means of bearings (only indicated here). A rivet head 21 adjoins the drive shaft 19 at the bottom. The rivet head 21 also serves as a tool holder. The latter, for example as a riveting tool, can contain a riveting set 22.

In addition, the preferably fixed machine housing 3 and the plunger 4 which can be moved in the machine housing 3 in the direction of a Z axis 23, has a travel measuring device 24 which is connected via a further connecting line 15.4 to the control device 16. This control device 16 performs all the regulating and controlling functions which are necessary to operate the riveting machine R.

The data which are necessary for this can, if appropriate, be input via a computer 25 and evaluated during or after an operation, and output there. However, this is only exemplary here. In particular, such a control device 16 can be integrated into an existing production facility, in order also to operate a corresponding riveting machine R completely automatically.

However, an essential feature of the present invention is that, as indicted schematically in FIG. 1, a sensor element 26.1 is inserted into the pressure line 11, and a sensor element 26.2 is inserted into the venting line 12. Preferably, the sensor elements 26.1, 26.2 near to the machine housing 3 are inserted into the pressure line 11 or venting line 12. The sensor elements 26.1, 26.2 are also connected to the control device 16 via connecting lines 15.5, 15.6. It is important here also that the sensor elements 26.1, 26.2 are inserted between the control valves 13, 14 and the machine housing 3 into the pressure line 26.1 and venting line 26.2, respectively.

The sensor elements 26.1, 26.2, which are preferably designed as pressure sensors or else as pressure transmitters, can sense very precisely a change in pressure in the pressure line 11 or venting line 12 if, during the displacement, the plunger 4 strikes against a workpiece 27 to be processed. Directly when the plunger strikes against the workpiece 27, for example against a rivet, a change in pressure is brought about in the pressure line 11, said change being registered immediately via the sensor elements 26.1, 26.2 and correspondingly in the pressure and venting line lines. The effect of this change in pressure is that a start or a displacement of the zero point can be calculated. The precise determination of the start of the riveting operation is necessary in order to be able to determine precisely the shaping travel necessary for optimum shaping. If the start of the riveting operation is known, the shaping travel can be determined precisely by means of further displacement using the travel measuring device 24. This may also be possible by means of continuous displacement and determination of the time. It is advantageous here that a precise determination of the start of the shaping operation can be acquired by means of the change in pressure in the sensor elements 26.1, 26.2.

In a further exemplary embodiment of the present invention in accordance with FIG. 2, a shaping machine $R_1$, in a riveting machine, is illustrated, in which the sensor elements 26.3, 26.4 are inserted into an upper plunger space 7 and lower plunger space 8. Preferably, an adjustable throttle valve 29 is inserted into the venting line 12. Said valve 29 can be connected to the control device 16. As a result, the displacement of the plunger 4, in particular into a lower position, can be damped. A hard impact of the plunger after the downward displacement is prevented by this throttle valve 29. In addition, the forward travel of the spindle can be regulated by means of the throttle valve 29, and it is also possible to change the speed of the displacement travel of the spindles and/or of the plunger 4.

The sensor elements 26.3, 26.4 are connected to the control device 16 via the connecting lines 15.7, 15.8. Here too, it is possible to determine precisely if, as a result of a change in pressure, the rivet head 21 with a rivet tool, for example the riveting set 22, strikes against a workpiece 27. By means of the change in pressure, it is possible to determine precisely not only the start of the riveting operation but also the shaping force calculated from the change in pressure. By determining the start of the riveting operation and/or the start of the shaping operation, which is to be equivalent to a start of a process during which either the riveting time or the travel is prescribed, the riveting results can be checked and determined precisely.

If, for example, the shaping travel is known or prescribed, the quality of the shaping procedure is influenced by means of an additional time comparison. If a specific predetermined distance is traveled within a specific time, the shaping and/or the riveting is successful. In order to make a comparison possible, a specific time is determined, for example, in the trial, and a time tolerance factor is defined in order to detect a positive or negative riveting result.

In addition, a prescribed time for shaping and/or riveting may also be prescribed after the start of the riveting operation has been precisely determined, the distance which has been traveled then being used as comparison parameter in order to assess a riveting result. The distance which has been traveled can be determined precisely by means of the travel measuring unit; however, it is defined, for example, by means of a trial or by specifically defining a travel tolerance which serves as comparison tolerance factor for a successful shaping operation.

If, during the riveting or shaping operation, the travel tolerance is not complied with after a prescribed time, this makes it possible to draw conclusions relating to a fault in the shaping process. This can have a plurality of causes, for example the rivet is too long, the workpiece is too thick or the wear of the material is too high. In addition, there may also be material faults. By specifying time or travel tolerance windows which can be determined by trials and can be used by means of software for the comparison, it is possible to determine precisely the riveting process, and in particular a shaping result of the workpiece. The precise determination of the start of the riveting operation by sensing and determining the change in pressure and/or change in force plays an essential part in this. For example, the change in pressure could be determined as a pressure differential from the pressure in the upper plunger space in comparison with the pressure in the lower plunger space. Therefore, it is always possible to determine the start of the riveting operation precisely, in particular in riveting machines which operate according to a wobbling method or radial method.

This leads to a reduction in the rejection rate and to an increase in the precision of a rivet connection, and at the same time to the detection of faulty workpieces which do not meet the requirements.

What is claimed is:

1. A method for controlling, monitoring and checking a shaping procedure of a shaping machine, which comprises:

providing a shaping machine operative to perform a shaping operation on a workpiece;

moving a plunger on said shaping machine in contact with said workpiece;

subjecting at least one of an upper plunger face and a lower plunger face to pressure in order to move the plunger; and measuring a change in pressure when the plunger strikes against the workpiece in order to determine the start of said shaping operation, wherein said change in pressure is determined as a pressure differential from the pressure in the upper plunger face less the pressure in the lower plunger face, and wherein said measuring signals the start of said shaping operation.

2. A method according to claim 1, wherein said shaping machine is a riveting machine, and including the step of measuring a change in pressure when the plunger strikes against the workpiece in order to determine the start of a riveting operation.

3. A method according to claim 1, including indicating and calculating a shaping force during the entire shaping operation by means of a change in pressure and measuring a pressure differential.

4. A method according to claim 1, including providing an upper plunger space contacting the upper plunger face and a lower plunger space contacting the lower plunger face, wherein the change in pressure when the plunger strikes against the workpiece is determined directly in at least one of the upper and lower plunger space.

5. A method according to claim 1, wherein the change in pressure when the plunger strikes against the workpiece is determined directly in at least one of a pressure line and a venting line.

6. A method according to claim 1, wherein the change in pressure when the plunger strikes against the workpiece is determined with at least one sensor element.

7. A method according to claim 1, wherein at least one of the start of shaping travel and the start of shaping time is determined by determining the change in pressure, and determining the start of the shaping procedure.

8. A method according to claim 7, wherein a zero point is displaced to a start of a workpiece by determining the start of a shaping procedure.

9. A method according to claim 8, wherein shaping is determined by displacing and determining the zero point as the start of a shaping operation over at least one of a predeterminable duration, a predeterminable shaping travel, and a predeterminable shaping force.

10. A method according to claim 9, including determining a faulty shaping as a result of determining a duration of at least one of predetermined parameters and relations of the parameters, for each shaping travel.

11. A method according to claim 10, wherein said predetermined parameters include at least one of the start of a shaping operation, time of a shaping operation, and force of shaping.

12. A method according to claim 6, wherein after determining at least one of the start of a shaping operation and the start of the process, a prescribed shaping travel is determined, and faulty shaping is determined by means of a time comparison.

13. A method according to claim 6, wherein after determining at least one of the start of a shaping operation and the start of the process at a predetermined time, a distance which has been traveled is determined as a comparison parameter for determining faulty shaping.

14. A method according to claim 6, wherein after determining the start of a shaping operation and the start of a process for a predetermined travel, a force window is determined as a comparison parameter for determining faulty shaping.

15. a method according to claim 6, wherein after the start of a shaping operation has been determined, at least one of the shaping work and the shaping work per time unit, is determined as a comparison parameter for determining faulty shaping.

16. A shaping machine operative to perform a shaping operation on a workpiece, which comprises;

a machine housing;

a plunger moveable on an axis towards a workpiece guided in said machine housing so as to be displaceable under pressure;

a cavity which is divided into an upper plunger space and a lower plunger space;

a plunger flange displaceable in said cavity;

a pressure line leading into the upper plunger space and a venting line leading into the lower plunger space; and at least one sensor element assigned to at least one of said pressure line, venting line, upper plunger space, and lower plunger space operative to measure a change in pressure when the plunger strikes against a workpiece in order to determine the start of said shaping operation, wherein said change in pressure is determined as a pressure differential from the pressure in the upper plunger face less the pressure in the lower plunger face, and wherein said measuring signals the start of the said shaping operation.

17. Shaping machine according to claim 16, wherein said shaping machine is a riveting machine and including a riveting set attached to said plunger, wherein said sensor element is operative to sense when the riveting set strikes against a workpiece.

18. Shaping machine according to claim 16, wherein said at least one sensor element is assigned to at least one of said pressure line and venting line.

19. Shaping machine according to claim 16, wherein in order to measure a change in pressure when the plunger strikes against a workpiece, at least one sensor element is provided in the venting line, a further sensor is provided in at least one of the pressure line and upper plunger space, and a further sensor is provided in the lower plunger space.

20. A shaping machine according to claim 19, including determining a pressure differential between the venting line and pressure line.

21. A shaping machine according to claim 16, including a control valve in each of the pressure line and venting line, wherein a sensor element is provided in at least one of the pressure line and venting line between said control valve and upper and lower pressure space.

22. A shaping machine according to claim 16, wherein said sensor element is connected to a control device.

23. A shaping machine according to claim 16, wherein the plunger displaceable along a Z axis.

* * * * *